United States Patent [19]

Hudson

[11] Patent Number: 4,747,284

[45] Date of Patent: May 31, 1988

[54] METAL SPINNING MACHINE CARRIAGE AND PROCESS FOR THE OPERATION OF A METAL SPINNING MACHINE

[76] Inventor: Robert Hudson, 19402 Coralwood La., Huntington Beach, Calif. 92646

[21] Appl. No.: 19,825

[22] Filed: Feb. 27, 1987

[30] Foreign Application Priority Data

Aug. 5, 1986 [DE] Fed. Rep. of Germany 3626495

[51] Int. Cl.[4] ..... B21D 22/16

[52] U.S. Cl. ..... 72/83; 72/85

[58] Field of Search ..... 407/8; 72/81, 83, 85, 72/19

[56] References Cited

U.S. PATENT DOCUMENTS 4,509,351 4/1985 Rolin et al. ..... 72/83

4,565,081 1/1986 Massee ..... 72/83

*Primary Examiner*—Lowell A. Larson

*Attorney, Agent, or Firm*—Klein and Vibber

[57] ABSTRACT

A forming wheel carriage for a CNC controlled metal spinning machine having a forming wheel post arranged to be movable relative to a second slide, and a process for operation of the metal spinning machine. During operation the forming wheel post is attached relative to the second slide by means of a ball flexibly mounted on the second slide engaged into a recess of the forming wheel post. The ball deflects backwards during overload, and the forming wheel with the forming wheel post can deflect immediately relative to the second slide. The forming wheel post deflects within a horizontal plane in accordance with a pre-selected force independent of the direction of the overload force. The force can be changed during an overload at a relief valve by means of a control unit by way of a control line. This manner of attachment of the forming wheel post allows for an automatic registering of the spindle tool contour. The contour is recorded point by point. This entails the repeated passage of the wheel with minimal push against the spindle tool. In addition, the positioning means serves as an overload check and emergency shut off switch.

13 Claims, 2 Drawing Sheets

METAL SPINNING MACHINE CARRIAGE AND PROCESS FOR THE OPERATION OF A METAL SPINNING MACHINE

BACKGROUND OF THE INVENTION

The invention is related to a metal spinning machine carriage and the process for the operation of metal spinning machines.

The invention concerns the construction of carriages of metal spinning machines essentially CNC (Computer Numeric Controlled) controlled, such that certain modes of operation are made possible which simplify the work of the machine operator or relieve him from routine operation.

In this connection, initial reference should be made to the "Teach-in-Process", also known as "Play-back-Process".

If a new program is run for the first time on a metal spinning machine, then the contour of the tool must be provided for in the program as an Emergency-Off-Line. In this regard the geometry of the tool and the forming wheel is inputted, or the tool must be carefully run off by hand. Subsequently, with the help of the program and as a safety check, the contour of the tool in conjunction with the measurement for the predetermined thickness of the workpiece is run off and the distance between the forming wheel and the tool is measured at a series of individual points. This mode of operation is very time consuming.

Likewise, the same applies, if a program which has been run on a metal spinning machine with a particular tool before, is to be run anew. For safety purposes a check must first be made whether or not, during any phase of the program, the forming wheel impacts against the tool.

When working with sensitive materials the range of permissible pressure is often very narrow, so that on the one hand a lower force limit must be established such that the workpiece can be pressed against the tool, and on the other hand there is an upper limit which cannot be transgressed without damaging the upper surface of the forming wheel.

A path control of the carriage taking into consideration the maximum and minimum force involves a considerable amount of time and energy.

DESCRIPTION OF THE PRIOR ART

The EP-OS No. 125720 discloses a wheel post slidably mounted in radial direction against the force of a biasing means in order to overcome excessive loads. From this it is further known in the art to measure the axial forces which are effected onto the forming wheel and independently thereof to pull back the carriage. It is also shown that the force of the biasing means supporting the wheel post in radial direction can be altered.

The solution does not offer any simplification of the recording, i.e. the registration of the contour of the tool. The danger of setting in of oscillations is present in the operation of the metal spinning machine using the biasing means supported wheel post. The biasing means only averts the radial force; the resulting force, which is a combination of the radial and axial forces, is not registered and is not used in controlling the machine.

SUMMARY OF THE INVENTION

The invention addresses the problem, by avoiding the aforementioned drawbacks, using a preferably CNC controlled metal spinning machine for achieving the positioning of the forming wheel post which allows for an automatic operation during the recording of the tool contour and enables the improvement of the metal spinning process with sensitive materials.

The solution of the problem is given in the body of claim 1. The force of a piston-cylinder (biasing means which can also be a spring) is converted, that is it works on a frontally tapered thrust piece which rests in the depression of the forming wheel post. The depression would be a conical bore or a pyramid formed recess in the forming wheel post. Important here is the mobility of the forming wheel post. The forming wheel post must be movable by a few millimeters both in the axial as well as in the radial direction in case of an overload situation, i.e. the maximum permissible spinning force is reached. In consideration of the resulting automatic resetting and the forward thrust speedtime during an emergency shut off, the mobility of the forming wheel post must be such that the forward thrust already performed within the resetting time lies within the mobility of the forming wheel post.

The essential advantage of the invention is that the maximum force exerted during contact is always equal, independent of the direction in which the force works upon the forming wheel. This is not a matter simply of the axial force components and the radial force components. The forming wheel post can deflect all around in any direction. The mobility of the forming wheel post, after exceeding a set pressure force, is 360 degrees in the horizontal plane of common metal spinning machines in which the forming wheel post is located. This plane approximately corresponds to a longitudinal cross sectional plane in which lies the spindle axis of the metal spinning machine.

If the forming wheel post evades under the force between workpiece and forming wheel and against the force of the biasing means which supports the thrust piece, then a switch is activated which signals that measures must be taken which prevent any damage. The switch is supposed to signal the evasion of the forming wheel post movement from the movement of the remaining system.

The particular inventive feature of the present apparatus lies in the fact, as noted above, that an overload on the forming wheel or the tool is securely prevented, since the wheel with the post already moves away or deflects when the "overload" signals, and this evasive action need not be initiated beforehand by the metal spinning machine computer.

In accordance with claim 3, another preferred embodiment of the invention, the apparatus is supplemented with an additional switch dependent upon the function of the first switch. During scanning of the tool for the programmable setting of the dependent emergency exit line of the contour, the first switch becomes operational signaling the technically smallest possible movement of the thrust piece in front of the biasing means. During operation of the metal spinning machine, minor aberrations in the preprogrammed path of the forming wheel are to be tolerated, which is helpful for both the computer programmed and the manual control of the metal spinning machine. During computer programmed control of the machine, material tolerances of the workpiece can determine minimal deviations of the wheel under consideration of the maximum allowable force. An emergency shut off of the machine is only necessary, if the predetermined tolerance is exceeded by the deviation of the forming wheel post.

In accordance with claim 4, the switches are arranged such that their operation results within the movement path of the thrust piece inside the depression. The thrust piece never leaves the depression during operation of the metal spinning machine.

In order to guarantee an essentially unchanged force on the forming wheel, even during the evasive action of the thrust piece, the thrust piece and the depression are designed as in claim 5. This further embodiment allows for the ball to be easily exchanged after wear, and guarantees easy roll off in the depression after overload results from any direction.

The embodiment of the invention according to claim 5 is made in order to achieve a minimal elastic deformation of the forming wheel post before the activation of the switch.

Claim 7 takes into consideration the possibility that at different points on the workpiece, different forces may be allowable. In order to compute this circumstance for an automatic production process, it is determined that the force with which the thrust piece pushes against the workpiece is varied and this variation is completed through program control during the work cycle of the metal spinning machine.

In accordance with claim 8, the biasing means, which presses the thrust piece into the depression of the forming wheel post, is designed hydraulically or pneumatically. This allows for the result that the force for additional backward pressure does not increase even during evasive movement of the thrust piece, which would be the expected behavior of a mechanical biasing means. With an hydraulic or pneumatic solution a pressure relief valve will make sure that the force will remain constant over the total "spring path".

With an hydraulic or pneumatic solution, the aforementioned regulation unit is preferably designed as a servo control valve in accordance with claim 9 in which the permissible pressure during the run over can be arbitrarily varied by programming means within the scope of the design.

In accordance with claim 10 the forming wheel post is designed as a third slide which is movable in two directions. This guarantees that the forming wheel can take evasive action or deflect with respect to an overload in axial and radial directions, either positive or negative.

The aforementioned features of the invention allow for an automatic scanning of the tool with the forming wheel. Practically all eventualities of accidental mistaken selection of forming wheel or tool, as well as human error, become harmless because the CNC controlled metal spinning machine itself automatically records the tool contour and thereby prevents damage occurring to the wheel, workpiece or tool.

As further noted in the process of claim 11, the wheel radially approaches the tool. As soon as the wheel comes into contact with the tool the thrust piece activates the switch and the position of the first and second slides, upon which the respective forming wheel is arranged, is instantaneously electronically recorded with respect to the coordinates of the wheel. The wheel, then, proceeds a bit further, preferably in a U shaped path, until the switch is again activated by the tool contour by way of the wheel and the forming wheel post. By this means the complete tool contour is recorded during automation, taking into consideration the geometry of the forming wheels.

The novelty of the solution according to claim 12 is seen in the combination of a pressure control and a path control, and in that, despite the predetermined pressure control, the wheel is not arranged in a floating manner during normal operation. In this manner the setting in of oscillations is prevented or reduced and the effect of a force limitation on the one hand and an exact path control on the other hand are maintained. For normal operation of the metal spinning machine, the evasion movement of the forming wheel post is measured so that the predictable tolerances of the workpiece material and its dimensions can be recorded before the activation of the emergency shut off switch. The machine is only turned off when the pressure occurrence is outside of the expected range of increase thus causing an additional deviation of the press wheel with the forming wheel post.

While the following description and the drawings describe and illustrate the thrust piece as being located between a slide and the forming wheel post it is within the scope of this invention to mount the thrust piece between the press wheel and the forming wheel post.

BRIEF DESCRIPTION OF THE DRAWINGS

These and other objects and features of the invention will become apparent with reference to the following detailed specification and to the drawings wherein.

DETAILED SPECIFICATION

Figure 1:
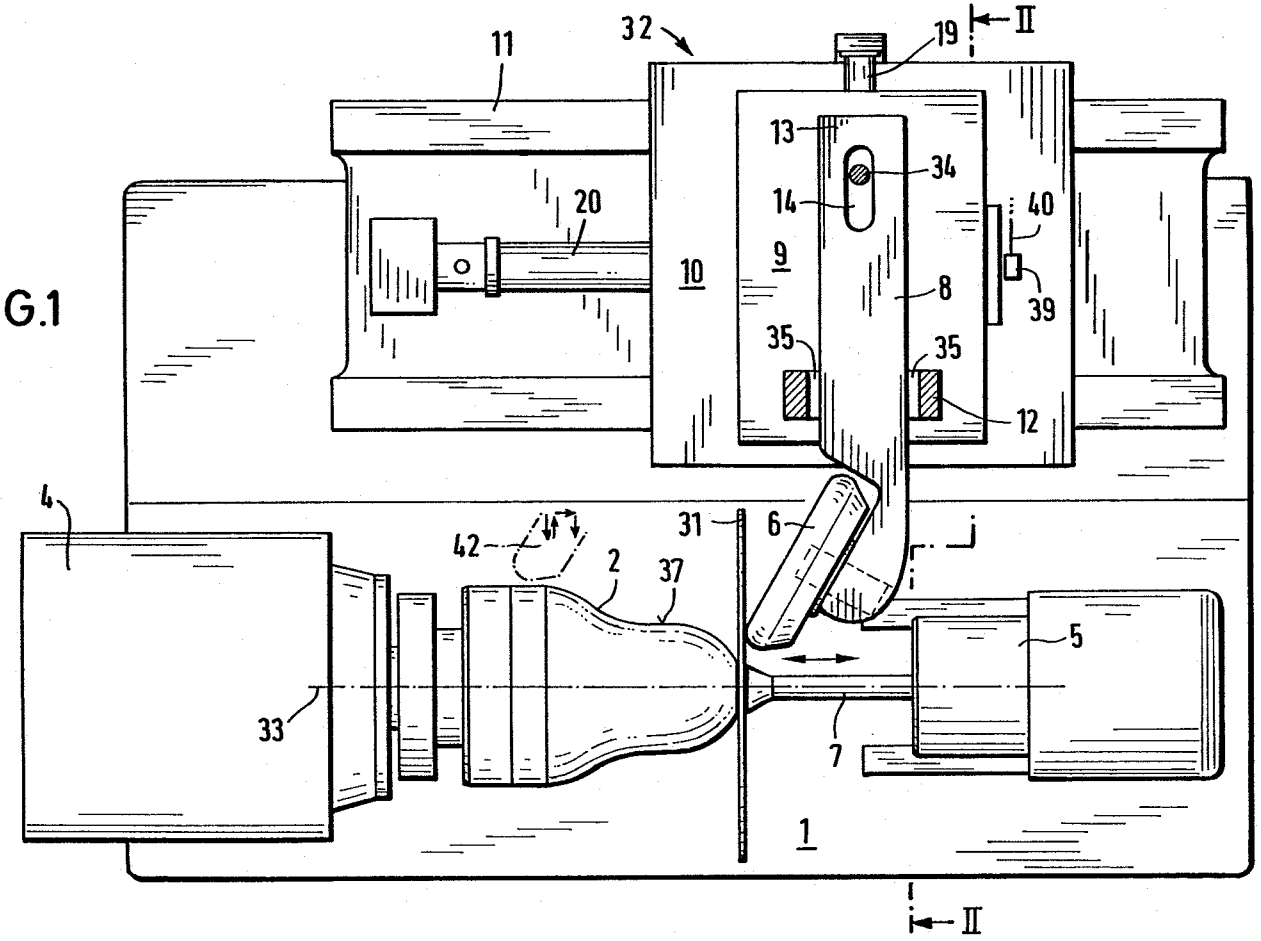
FIG. 1 is a schematic representation of a metal spinning machine from a top view.

The metal spinning machine shown in FIG. 1 comprises a machine frame 1, a work spindle or headstock 4 arranged thereon with a spindle tool 2, a tailstock 5, a gripping device or chuck 7 and carriage 32 for a forming wheel 6. The carriage 32 can be moved on a machine bench guideway 11 in the direction of the spindle axis 33. The carriage 32 comprises a first slide 10 which slides along in axial direction on the guideway 11 and is controlled from there by an operating cylinder 20. A second slide 9 is arranged on the first slide 10 and can be moved in radial direction towards the spindle axis 33 by means of an operating cylinder 19. The position of the first slide 10 is sent to a control unit 21 by way of a detection device 38 and a signal line 41. The detection device 39 with the signal line 40 has the identical function for the second slide 9. The forming wheel post 8 is movably mounted onto the second slide, its longitudinal plane parallel to the spindle axis 33. The forming wheel post 8 is fixed onto the second slide 9 at its rearward end 13 with a setbolt 34 and a yoke 12. The forming wheel post has a rectangular cross section and the yoke surrounds it above and below in a closed manner having play 35 on both sides. The set bolt 34 penetrates through a oblong hole 14 in the forming wheel post 8. Due to the play 35 and oblong hole 14, the forming wheel post 8 can be moved in a horizontal plane relative to the second slide 9 by a few millimeters in any direction. The mobility is guaranteed in all directions within the aforementioned plane.

Figure 2:
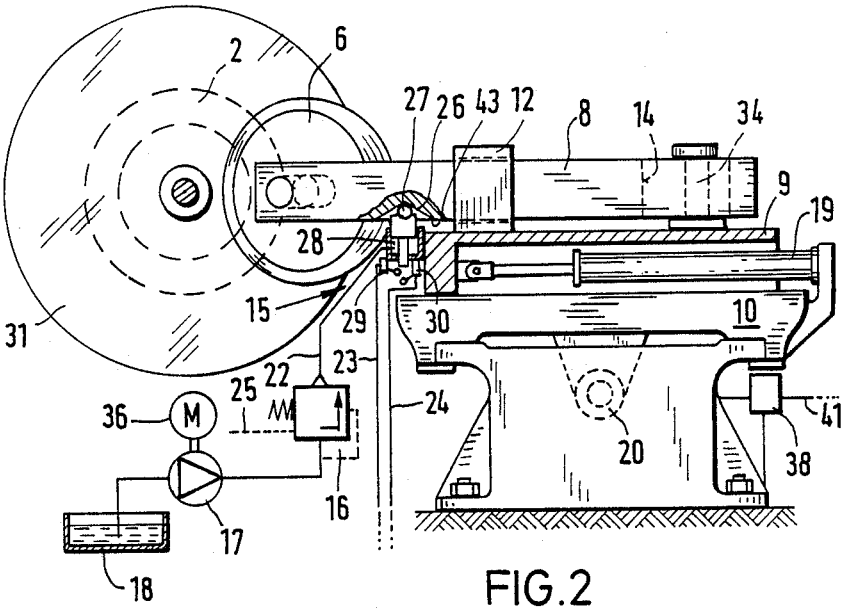
FIG. 2 is a cross sectional view along the line II—II in FIG. 1.

As shown in FIG. 2, the forming wheel post 8 is generally set by a positioning means 15 relative to the second slide. The positioning means 15 is arranged immediately adjacent the forming wheel 6. It is placed approximately in the plane in which the forming wheel post 8 can be moved. The positioning means 15 comprises a cylinder 28 which is fed pressure medium by way of a line 22. The cylinder, in conjunction with the relief valve 16 remote controlled by way of the control line 25, has the effect of a biasing means with which the ball 27 attached to the front end of the piston of the cylinder 28 presses into a depression 26 on the underside of the forming wheel post 8. The depression 26 has, on the basis of its conical shape, a closed edge 43 and secures the forming wheel post 8 against any displacement within an angular range of 360 degrees relative to the second, top slide 9.

The cylinder 28 is attached to the second slide 9. The pressure in cylinder 28 is created by means of a motor 36 driven pump 17 which draws the pressure medium from a tank 18.

In the prior art the post 8 is firmly attached to the upper slide 9. In the present invention, on the other hand, the improvement lies in the fact that the forming wheel post 8, and more precisely the forming wheel 6, is movable in a preferably horizontal plane for a few millimeters in all directions of that plane in the case of an overload situation. Under normal woking conditions the forming wheel post 8 is rigidly attached to the upper slide 9. The forming wheel post 8 is kept in position by the thrust piece 45 that is guided in the upper slide 9 in vertical direction and urges the ball 27 above it into the conical depression 26 on the lower side of the forming wheel post 8. The forming wheel post 8 may then evade or shift for a few millimeters when the maximum permissible spinning force is reached. When this happens, the ball 27 glides down on the conical surface of the depression in the wheel post. This overload situation is signalled by switches 29 and 30. The thrust piece 45 is thus what presses the ball 27, by way of the biasing means and piston under the ball into the depression.

Figure 3:
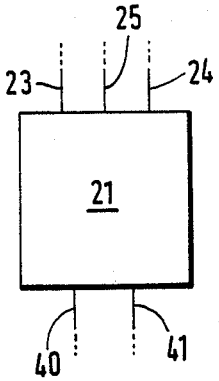
FIG. 3 is a schematic representation of the control of the metal spinning machine.

As shown in FIG. 3, the lines 23, 24, and 25 are connected with the control unit 21.

In a first mode of operation, the contour 37 of the tool 2 is automatically registered. Here the forming wheel 6 with the forming wheel post 8 and the slide 9 moves radially towards the tool 2, approximately as schematically shown at 42 in FIG. 1. As soon as the forming wheel 6 contacts the tool 2 (the forming wheel 6 generally moves in a horizontal plane, that is a movement at right angle to the surface being worked by the forming wheel 6, the forming wheel post 8 with the forming wheel 6 evades backwards relative to the second slide 9 in a radial direction. The ball 27 is thereby pressed back against the pressure of the cylinder 28 onto the incline of the depression 26. As soon as the piston of cylinder 28 begins to move backwards, it activates the switch 29 which signals the control unit 21 by way of the line 23 that the wheel has reached the tool. At this moment, by means of the detection devices 38, 39, the position of the slides 9 and 10 are electronically recorded and saved in the metal spinning machine computer. Subsequently the forming wheel 6 is moved backwards, sideways and again forwards in a U-shaped path corresponding to the arrow arrangement at 42 until the wheel again contacts the tool. During the backward movement the ball 27 automatically presses itself back into its original position. The sideways movement amounts to only a few tenths of a millimeter. In this manner a point by point picture of the tool contour is automatically drawn for the metal spinning machine computer, which serves as a delimitation line for the control of the wheel during metal spinning machine operation, if necessary, with a still to be computed wall thickness of the workpiece.

In a second mode of operation when pressing sensitive workpieces, the positioning means serves simultaneously as a cushion and as a control device. The basis for this mode of operation is the controlling of the path of the forming wheel with slides 9 and 10. The switch 29 is of no importance in this process and its switch impulses are ignored by the control unit 21. Despite the tolerances needed to be designated for the workpieces 31, the forming wheel 6 is to be moved vertically downwardly onto the workpiece 31 with constant force for the straight working of the contour seciton. The ball 27 deflects backwards slightly when the minimal wall thickness of the workpiece 31 is exceeded and thereby likewise allows the forming wheel 6 a minimal evasion movement. Only after this evasion movement exceeds the tolerance field determined by the backward positioned arrangement of switch 30, does the cylinder piston 28 activate the switch 30 and stop the machine. After exceeding the limited tolerance by way of the backward positioned arrangement of switch 30, it may be assumed that manual intervention is required.

The force permitted the forming wheel against the workpiece can be controlled during the overload by means of changing the pressure in the cylinder 28. The pressure entering the cylinder 28 is determined and varied by the control unit 21 by way of the control line 25.

In both modes of operation the ball 27 remains in every instance in the region of the depression 26 and always guides the forming wheel post back into the position shown in FIG. 2 after the pulling back of the slide 9 or 10.

The inventive solution has the advantage that in every instance an initial and immediate evasion of the forming wheel 6 is possible without switch delay and without any further conditions. Thereby it is unimportant whether the evasion occurs in radial or axial direction. The forming wheel post evades in both directions, more precisely, in any direction within the horizontal plane relative to the slide 9 with equal force and activates the switch 29 or 30 depending upon the mode of operation. This force results from the pressure determined by the cylinder 28.

While there has been described a particular embodiment of a new and improved metal spinning machine carriage and various embodiments for its operation, it will be apparent to those skilled in the art that variations may be made thereto without departing from the spirit of the invention and the scope of the appended claims.

I claim:

1. A carriage for a metal spinning machine comprising a first slide movable on a machine frame; a second slide movable on the first slide; a forming wheel mounted on a forming wheel post and movably mounted with respect to the first and second slides; biasing means and a thrust piece engaged by the biasing means and arranged between the forming wheel and the second slide; the thrust piece being operatively connected to at least one switch, the switch being connected with a control unit of the metal spinning machine; the thrust piece operatively engaging a recession rigidly connected to said forming wheel;

wherein the thrust piece and the biasing means hold the forming wheel in operable position under regular working conditions.

2. A metal spinning machine carriage according to claim 1, wherein said thrust piece has protruding means which engage in a recess in said second slide.

3. A metal spinning machine carriage as described in claim 1 further comprising an additional switch arranged between the thrust piece and the second slide which is also connected to the control unit of the metal spinning machine, wherein the additional switch is arranged in backward position.

4. A metal spinning machine carriage according to claim 3, wherein the distance between the two switches corresponds to a path section of the thrust piece in the recess.

5. A metal spinning machine carriage according to claim 4 wherein the recess and the thrust piece are matingly spherically shaped.

6. A metal spinning machine carriage according to claim 5 wherein the biasing means and thrust piece engage the forming wheel post in the region between the forming wheel and the next neighboring support of the forming wheel post on the second slide.

7. A metal spinning machine carriage according to claim 5, wherein the force of the biasing means can be pre-selected, whereby the biasing means is assigned a position unit which is connected to the metal spinning machine control unit.

8. A metal spinning machine carriage according to claim 5, wherein the biasing means is comprised of a pressure cylinder with a pressure medium.

9. A metal spinning machine carriage according to claim 5, wherein a pressure relief valve is connected to the pressure cylinder and is also connected with the machine control unit by way of a control line.

10. A metal spinning machine carriage according to claim 9 wherein the forming wheel post has an additional slide movable in any direction in a longitudinal plane parallel to the machine spindle axis, and the depression, to which is engaged the thrust piece, is arranged approximately within the longitudinal plane in which the forming wheel post can be movably guided.

11. A metal spinning machine carriage according to claim 1, wherein the recess has a roundabout tapered shape.

12. A process for the operation of a CNC controlled metal spinning machine, set up with a forming wheel post movable in axial and radial direction within the longitudinal plane of the spindle rotation axis, comprising the steps of:

scanning a spindle tool by a forming wheel;

approaching the spindle tool with the forming wheel, during the scanning, until the forming wheel post deflects with respect to its slide;

recording the coordinates of the contact point between the forming wheel and the spindle tool at the point at which forming wheel post deflects with respect to its slide;

retracting the forming wheel, at the recorded contact point, very slightly with the help of a guidance mechanism in a deviation path, thereby moving across and again towards the workpiece until contact occurs;

repeating the retracting until the total tool contour is registered point by point.

13. A process for the operation of a metal spinning machine in which the path of a forming wheel is controllably passed along the contour of a spindle tool and thereby shapes a workpiece, comprising the steps of:

supporting the forming wheel against the force of a biasing means on a carriage; and then running the forming wheel along the contour of the spindle tool by means of the carriage control so that the metal spinning machine automatically shuts off when the forming wheel exceeds a predetermined path along the contour of the spindle tool by a deformation force exerted by the workpiece on the forming wheel in any direction within a plane parallel to the axis of rotation of the machine spindle.

* * * * *